United States Patent [19]

Kirk

[11] Patent Number: 4,613,038

[45] Date of Patent: Sep. 23, 1986

[54] METHOD AND APPARATUS FOR MODULAR PACKAGING OF BICYCLE CABLES AND LOCKS

[75] Inventor: Randy W. Kirk, Culver City, Calif.

[73] Assignee: American Cycle Industries, Inc., Buena Park, Calif.

[21] Appl. No.: 784,786

[22] Filed: Oct. 4, 1985

[51] Int. Cl.[4] ..... B65D 73/00

[52] U.S. Cl. ..... 206/216; 206/389; 206/461; 206/477; 206/485; 53/409; 53/476

[58] Field of Search ..... 206/389, 400, 401, 461, 206/467, 480, 477, 485, 216; 53/409, 396, 476

[56] References Cited

U.S. PATENT DOCUMENTS

| | | | |
|---|---|---|---|
| 3,371,774 | 3/1968 | Lilly | 206/461 |
| 3,881,257 | 5/1975 | Chasen | 206/461 |
| 4,020,694 | 5/1977 | Mayhew | 206/461 |
| 4,141,448 | 2/1979 | Mascia et al. | 206/485 |

FOREIGN PATENT DOCUMENTS 1046487 12/1951 France .

*Primary Examiner*—Joseph Man-Fu Moy
*Attorney, Agent, or Firm*—Charles H. Thomas

[57] ABSTRACT

A system is provided for interchangeably packaging different types of bicycle cables and different types of bicycle locks in selected combinations. Each bicycle cable is separately enclosed in a bicycle cable package interchangeable with other, identical bicycle cable packages. Each bicycle cable package includes a bubble pack covering a coiled cable beneath a bubble. The bubble has an annular interior wall which defines a cavity and also a plurality of spaced, coplanar slots. Interchangeable bicycle lock packages are also provided. Each of the bicycle lock packages includes a stiff backing having divergent, coplanar tabs adapted for insertion into the corresponding slots in the interior bubble wall of each cable package. The cable packages are mutually interchangeable, as are the bicycle lock packages. By selectively assembling a bicycle lock package with a bicycle cable package, numerous different cable and lock combinations can be packaged and sold together as a unit.

15 Claims, 4 Drawing Figures

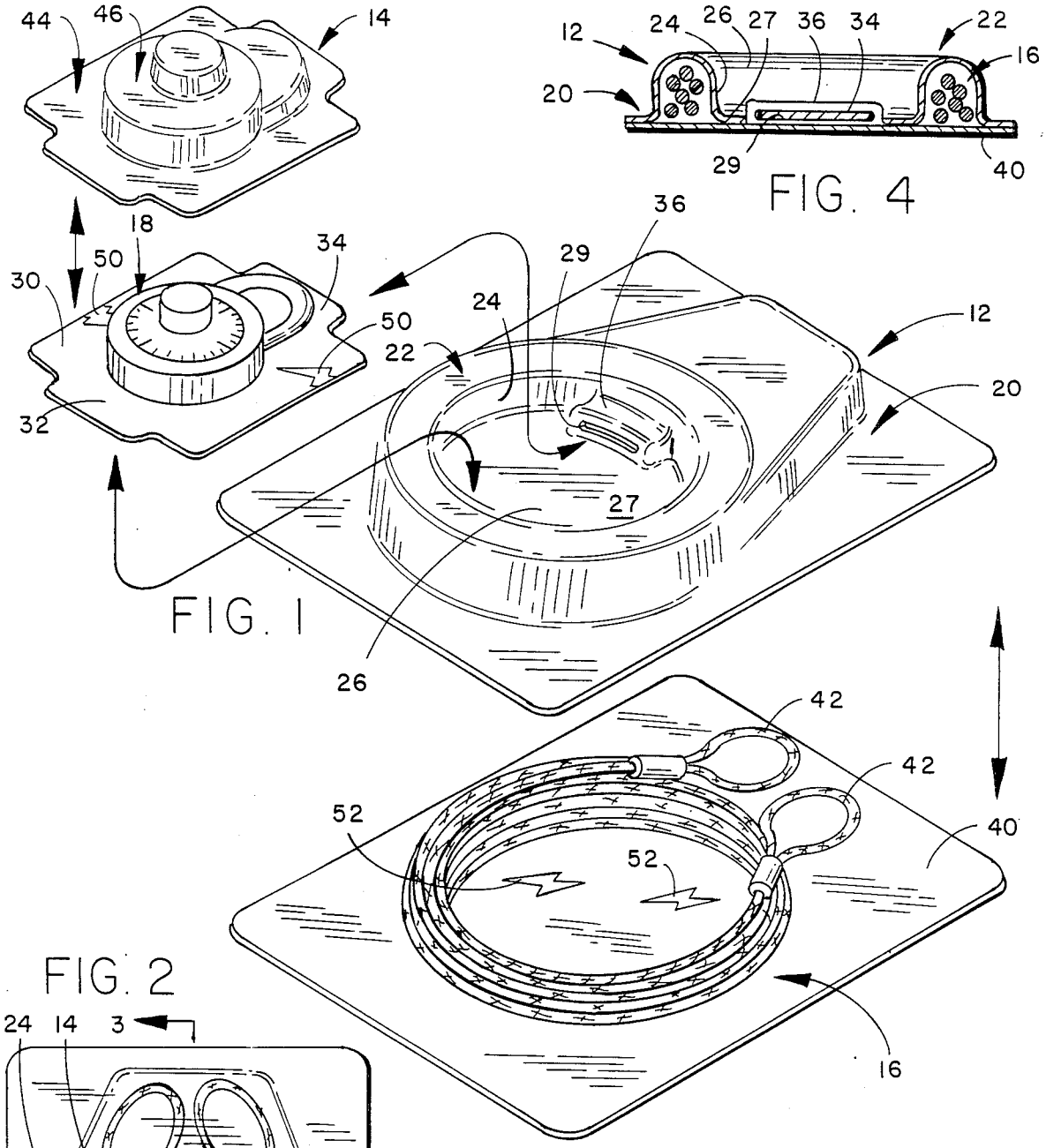
FIG. 1
FIG. 4
FIG. 2
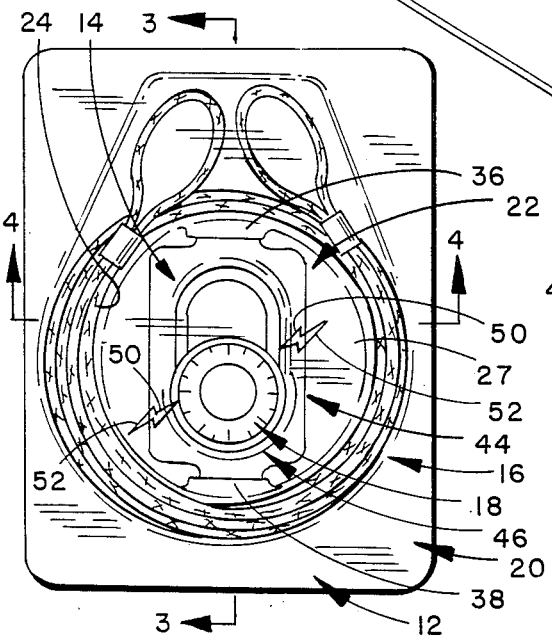
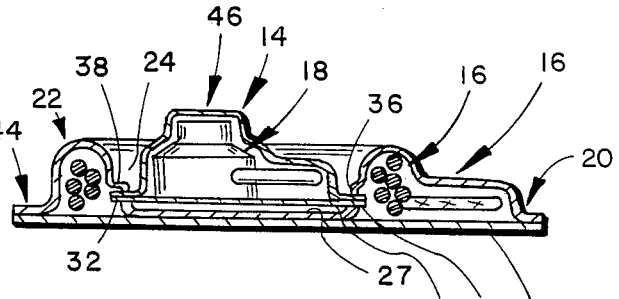
FIG. 3

METHOD AND APPARATUS FOR MODULAR PACKAGING OF BICYCLE CABLES AND LOCKS

BACKGROUND OF THE INVENTION

1. Field of the Invention

The present invention relates to a method and apparatus for packaging bicycle locks and bicycle cables together in numerous different combinations for sale in unitary sets.

2. Description of the Prior Art

At present, bicycle cables are sometimes packaged for sale in cable packages formed of a transparent, semi-rigid plastic sheet defining a bubble positioned atop some form of stiff backing. The backing may be formed of cardboard, or alternatively of another sheet of the same plastic. A plastic backing may either be flat or correspondingly configured with bubbles. In either manner of construction, the bubble configuration of the bicycle cable packaging is of a size and shape adapted to receive a coiled bicycle cable. Conventional stranded wire bicycle cables are conventionally packaged in looped circular turns which form a coil. Many different commercially available types and sizes of bicycle cables are coiled and packaged in bubble packaging of the type described.

Bicycle locks are frequently sold in bicycle lock packages. Such bicycle lock packages also frequently employ a sheet of transparent, semi-rigid plastic deformed to form a central bubble and are attached about the periphery to a cardboard backing. A bicycle lock is visible through the plastic bubble and is encapsulated between the bubble and a cardboard or plastic backing.

Bicycle cables and locks are sometimes packaged and sold together in sets within bubble packaging of the type described. Retail merchants who sell bicycles and bicycle accessories generally prefer to offer bicycle cables and locks for sale as sets, as the packaging of bicycle cables and locks together frequently maximizes revenue from the sale of such merchandise. However, there is a significant difficulty in packaging bicycle cables and locks together due to the considerable variety in models, styles, types, colors and materials of bicycle cables and locks. If bicycle cables and locks are packaged together, a very substantial inventory of such sets must be maintained on hand to provide customers with the particular cable-lock combinations which they desire.

The high investment in inventory which must be maintained on hand to provide customers with their choices of specific combinations of bicycle cables and locks when these devices are sold as sets, is evident from the fact that bicycle cables are conventionally offered for sale in 6 foot lengths having alternative plastic sheathed, stranded steel diameters of $\frac{1}{4}$ inch, 5/16 inches and 7/16 inches. Furthermore, each of the foregoing diameters of bicycle cables are also conventionally offered for sale in 7 foot lengths as well. Moreover, each type of cable is typically offered for sale sheathed in red, blue, black and silver plastic.

Numerous different models of bicycle locks are likewise sold throughout the bicycle industry. For example, a retail bicycle shop must typically be prepared to provide customers with steel laminated padlocks having shackles of 40, 45, 48 and 50 millimeters. Retailers must also be prepared to offer combination locks of the same shackle sizes of both the dial type, resettable type and push-button type. Furthermore, brass locks are frequently sold with shackles of both 40 millimeters and 50 millimeters. Other speciality type bicycle locks are also commercially available.

With the numerous different sizes, styles, colors and materials in which bicycle cables and locks are sold commercially, it is inordinately expensive for most bicycle merchants to maintain in stock any significant variety of sets of bicycle cables and locks packaged together. As a consequence, merchants are typically forced to incur the high cost of maintaining a sufficiennt inventory in order to enjoy the profitability of selling cables and locks together as a unit.

SUMMARY OF THE INVENTION

The present invention provides a method and apparatus for modular packaging of different combinations of bicycle cables and bicycle locks, without requiring a large inventory of different sets of cables and locks. According to the invention, bicycle cable packages and bicycle lock packages are selectively assembled together in different combinations of a single lock with a single cable. The bicycle cable packages are of modular design and closely resemble the conventional packaging of bicycle cables currently sold in commerce. The bicycle cable packages are interchangeable, and each package includes a bubble pack covering a bicycle cable located beneath a bubble that has an annular interior bubble wall defining a central cavity therewithin. A first fastening means is provided in the central cavity. Preferably, the fastening means of the bicycle cable package is formed by a plurality of coplanar slots separated from each other and defined in the interior surface of the bubble wall. Bicycle locks are likewise packaged in modular lock packages, each of which includes a stiff backing with a second fastening means aligned for removable, interchangeable engagement with the first fastening means in the interchangeable cable packages. Preferably, the second fastening means is formed of a plurality of laterally extending tabs which are oriented for releasable engagement in the slots of the cable packaging.

To engage the tabs in the slots, the stiff backing of the lock packaging is resiliently flexed so that a selected lock package may be positioned within the central cavity of the cable package. When the stiff backing of the lock package is released, it flattens out so that the tabs of the stiff backing enter the slots in the cable packaging to removably hold the lock packaging therein.

According to the system of the invention, a merchant is able to selectively assemble sets of different types of bicycle locks with different types of bicycle cables in many different combinations of a single lock with a single cable, without the necessity for maintaining inventories of the particular combinations assembled. When the lock packages are assembled with the cable packages, the resultant structure appears to be a unitary package combination of a cable and a lock from a manufacturer or distributor. The requisite inventory of bicycle cables and bicycle locks which distributors and retailers must maintain on hand is greatly reduced from that which would be necessary to adequately stock the different lock and cable combinations which may be assembled with the modular packaging of the invention. Even a modest inventory of the most popular styles of bicycle cables and bicycle locks will allow a merchant to provide many different combinations of locks and cables. Furthermore, because the bicycle lock packaging is releasably attachable to the bicycle cable packaging, the locks and cables may be rearranged into any different combination of goods on hand even after the goods are put on display for sale.

The system of the invention has applicability to both preformed bubble packaging, as well as to packaging in which transparent plastic is heat shrunken or vacuum formed onto bicycle cables and locks. In a preformed bubble package, a transparent plastic is premolded, or vacuum formed to a shape which will loosely cover a bicycle cable or bicycle lock. In this type of construction a sheet of plastic is shaped about a form of sufficiently general shape to accomodate a number of different styles of articles. In the case of bicycle cables, the preformed bubble has an annular interior wall which defines a cavity of 5 inches in inner diameter. The outer diameter of the bubble is large enough to accomodate different diameters and lengths of bicycle cables.

The system of the invention has particular applicability to this type of packaging construction because the transparent, preformed plastic bubble is stiff enough so that the interior bubble wall may be formed with radially inwardly directed, low-lying protrusions appearing as shelves or steps. The slots in the interior wall are preferably defined in these protrusions proximate the floor of the cavity. The volume within the protrusions located internally relative to the coiled cables is sufficient to accomodate the tabs of the stiff backing of the lock packaging without interference between the lock backing tabs and the coiled cable within the bubble.

The system of the invention may also be applied to bubble packaging where the bubble is constructed of transparent plastic heat shrunken upon a coiled cable or a lock. In this implementation the slots in the plastic bubble are defined near the base of the cavity encircled by the bubble, so that the tabs of the stiff lock packaging backing may be inserted beneath the coiled cable in the cable packaging.

The invention may be described with greater clarity and particularity by reference to the accompanying drawngs.

DESCRIPTION OF THE DRAWINGS

FIG. 1 is an exploded perspective view of modular packaging apparatus according to the invention.

FIG. 2 is a top plan view of the packaging of FIG. 1 shown assembled.

FIG. 3 is a sectional elevational view taken along the lines 3—3 of FIG. 2.

FIG. 4 is a sectional elevational view taken along the lines 4—4 of FIG. 2.

DESCRIPTION OF THE EMBODIMENT AND IMPLEMENTATION OF THE METHOD

FIG. 1 is an exploded view of a modular packaging appartus for selectively assembling together in different combinations sets of modular, interchangeable bicycle packages, one of which is indicated at 12, and modular, interchangeable bicycle lock packages, one of which is indicated at 14. Each combined set of bicycle cable and lock packages includes a single bicycle cable 16, and a single bicycle lock 18. Each interchangeable bicycle cable package 12 includes a bubble pack 20 covering a coiled cable 16 beneath a bubble 22. The bubble 22 has an annular, interior wall 24 defining a plurality of spaced, coplanar slots 28 therein. The wall 24 also defines a cavity indicated at 26. In the embodiment of FIGS. 1 through 4, there are two slots 28 and 29 located diametrically opposite each other across the cavity 26. The interchangeable bicycle lock package 14 includes a stiff backing 30, which may be formed of cardboard. The backing 30 has divergent coplanar tabs 32 and 34, adapted for insertion into the corresponding slots 28 and 29.

In the embodiment illustrated, the annular interior wall 24 includes a plurality of low protrusions 36 and 38 which protrude into the cavity 26. The slots 28 and 29 are defined in the protrusions 38 and 36, respectively. The bubble pack 20 of the bicycle cable package 12 is preferably constructed of preformed transparent plastic, which may be a semi-rigid plastic such as mylar approximately 10 millimeters in thickness. The bicycle cable package 12 also includes a flat, stiff cable backing support 40, which may be formed of a flat sheet also constructed of semi-rigid plastic, such as mylar, about 10 millimeters in thickness. Alternatively, the stiff cable backing support 40 may be formed of cardboard. In either event the perimeter of the cable bubble pack 20 is congruent to the perimeter of the stiff cable backing 40. The corners of both the bubble pack 20 and the cable backing support 40 are rounded so that there are no sharp corners to present a safety hazard. The facing peripheral margins of the bubble pack 20 and the cable backing support 40 are sealed together, as by heat sealing or with an adhesive, so as to encapsulate the cable 16. The cable 16 is coiled in circular loops, slightly larger than 5 inches in diameter. The ends of the cable 16 are each formed into eyes 42 which are located proximate to each other. The cable 16 is thereby loosely held and encapsulated between the transparent bubble 22 and the stiff cable backing support 40.

Preferably, each lock package 14 of the modular packaging apparatus includes a second configured bubble pack 44 with a central bubble 46 formed thereon. The bubble pack 44 is likewise preferably preformed of transparent mylar plastic, also 10 millimeters in thickness, similar to the bubble pack 20. The bubble 46 configured into the bubble 44 is formed in a size and shape adapted to accomodate the lock 18. The edges of the bubble pack 44 are coterminous with the edges of the stiff lock backing 30. The facing peripheral margins of the bubble pack 44 and the stiff lock backing 30 are either sealed together by an adhesive or are heat sealed, comparable to the manner of attachment of the cable bubble pack 20 to the cable backing support 40. The corners of the lock bubble pack 44 and the lock backing 30 are likewise rounded for safety reasons.

As best illustrated in FIG. 3, the shallow protrusions 36 and 38 are formed into the structure of the annular interior wall 24 of the bubble 22. The annular interior wall 24 is otherwise of a cylindrical configuration having an inner diameter of 5 inches. The protrusions 36 and 38 protrude radially inwardly into the cavity 26 proximate to the floor 27 thereof and proximate to the stiff cable backing support 40 therebeneath. The protrusions 36 and 38 serve to define enclosures which receive the tabs 32 and 34 of the lock backing 30 so that insertion of the tabs 32 and 34 into the slots 28 and 29, respectively, is not obstructed by the presence of the cable 16 within the bubble 22.

According to the packaging method of the invention, sets of different types of bicycle locks and different types of bicycle cables are assembled together in different combinations of a single lock with a single cable. That is, a lock 18 is selected from among a number of different styles and models. The lock package 14 accomodates numerous types of locks 18. Whatever the style, shackle diameter or structural material, the lock 18 is mounted upon the stiff backing 30 and beneath the bubble 46 of the bubble pack 44 and is encapsulated therebetween. Identical lock packages 14 may be used for different styles and models of locks 18.

Similarly, the cable 16 may be any one of numerous different lengths, diameters and colors. The bubble 22 is formed large enough to accomodate physical variations in cable size. Each different cable 16 is separately packaged in an identical cable package 12. Each cable package 12 includes a bubble 22 for receiving a coiled cable 16. The annular interior wall 24 of the bubble 22 is of a uniform geometric configuration and all of the slots are uniformly spaced and located in the wall 24. The wall 24 also defines a cavity 26 therewithin. The plurality of spaced, coplanar slots 28 and 29 are uniformly located in the protrusions 36 and 38, as previously described.

A merchant may select a lock package 14 containing a specific, desired model of lock 18 and assemble that lock package 14 with a selected cable package 12, containing a specific type of cable 16. Once selections of desired combinations are made, the bicycle cables 16 and bicycle locks 18 are assembled into sets.

Each selected lock package 14 is seated in a cavity 26 of a selected cable package 12 by first flexing the stiff lock backing 30 so that the tabs 32 and 34 will fit down into the cavity 26 and will clear the generally vertical facing surfaces of the protrusions 36 and 38. Flexure of the stiff lock backing 30 is resilient, so that when the flexing pressure is released, the lock backing 30 will return to its original, flat configuration, and the tabs 32 and 34 will extend into the slots 28 and 29 and hold the lock package 14 containing the lock 18 securely, but releasably, in the cavity 26.

When a lock package 14 and a cable package 12 are assembled together as a set in this fashion, the composite structure appears to be a unitary package. Such an appearance may be enhanced if design material 50 on the visible surface of the lock backing 30 is printed in such a manner as to represent a continuation of underlying design material 52 on the visible surface of the cable backing 40. That is, as illustrated in FIG. 2, the designs 50 on the upper surface of the lock backing 30 are coordinated with the underlying designs 52 on the cable backing 40 so that there is an apparent visual continuation between the designs on the two structures. The portions of the lightning bolt designs 50 on the lock backing 30 overlie corresponding portions of the same lightning bolt design 52 on the cable backing support 40.

It may well be desirable to rearrange different lock packages 14 with different cable packages 12 even after the composite packages are assembled together in a display for sale. Rearrangement is easily accomplished by pulling a lock package 14 upwardly away from the floor 27 of the cavity 26 of the cable package 12 associated therewith, so as to flex the lock backing 30. Such flexure results in the withdrawal of the tabs 32 and 34 from the slots 28 and 29 so that the lock package 14 can be readily removed from the cable package 12. If desired, the cable package 12 can then be sold separately as a unit. Alternatively, a different lock and cable combination may be assembled together. That is, a lock package 14 containing a different style or model of lock 18 may be combined with the cable package 12 by inserting the tabs 32 and 34 thereof into the slots 28 and 29 in the manner previously described. The effectuation of such rearrangement and recombination of different locks with different cables is highly useful in providing sufficient lock and cable sets to meet customer demand for particular lock and cable combinations from a relatively modest inventory of locks and cables.

Numerous other variations and modifications to the specific embodiment of the apparatus illustrated and the implementation of the method described will become readily apparent to those familiar with the packaging of bicycle locks and cables. For example, the bubble packs 20 and 44 need not be preformed, but may be constructed of transparent plastic heat shrunken upon the coiled cable 16 and the lock 18. Also, the annular interior wall 24 of the cable bubble pack 20 may contain any number of slots and the stiff lock backing 30 may likewise contain any number of tabs. Also, the lock backing 30 may be constructed so that several tabs fit into the same slot in the cable bubble pack 20.

In the embodiment of the invention illustrated, the cable package 12 is provided with a first fastening means in the form of the slots 28 and 29 in the annular interior wall 24, and the lock package 14 is provided with a second fastening means in the form of tabs 32 and 34, which project laterally from the stiff lock backing 30 and are insertable into the slots 28 and 29 to releasably hold the lock package 14 in the cavity 26. Alternatively, however, some other fastening mechanism may be employed. For example, a first fastening means on the floor 27 of the cavity 26 may coact with a second fastening means on the underside of the stiff lock backing 30. Conventional, mating velcro releasable fastening pads may be employed for this purpose. In such an arrangement one of the first and second fastening means is formed of a pad bearing a multiplicity of minute hooks and the other of the first and second fastening means is formed of a pad bearing a looped pile. The minute hooks are then releasably engageable in the looped pile to releasably secure a selected lock package 14 to a selected cable package 12.

There are numerous other modifications to the invention as well. Accordingly, the scope of the invention should not be construed as limited to the specific embodiment of the apparatus illustrated and the specific implementation of the method described. Rather, the scope of the invention is defined in the claims appended hereto.

I claim:

1. Modular packaging apparatus for selectively assembling together in different combinations sets of modular bicycle cable packages and bicycle lock packages, each set including a single bicycle cable and a single bicycle lock, comprising interchangeable bicycle cable packages each including a bubble pack covering a coiled cable beneath a bubble having an annular interior wall defining a plurality of spaced, coplanar slots therein and defining a cavity therewithin, and interchangeable bicycle lock packages each including a stiff backing having divergent coplanar tabs adapted for insertion into corresponding ones of said slots.

2. Modular packaging apparatus according to claim 1 wherein said annular interior wall includes a plurality of lateral protrusions into said cavity, and said slots are defined in said protrusions.

3. Modular packaging apparatus according to claim 1 wherein each of said bicycle cable packages includes a stiff cable backing located beneath said cavity.

4. Modular packaging apparatus according to claim 1 wherein each bubble is constructed of preformed transparent plastic.

5. Modular packaging apparatus according to claim 1 wherein each bubble is constructed of transparent plastic heat shrunken upon said coiled cable.

6. Modular packaging apparatus according to claim 1 wherein each lock package includes a second configured bubble atop said stiff backing to encapsulate a lock therebetween.

7. Modular packaging for bicycle locks and cables comprising a modular bubble package for a bicycle cable comprising a bubble covering a bicycle cable and having first fastening means, and an annular interior bubble wall defining a central cavity, and a modular lock package including a stiff backing with second fastening means aligned for removeable engagement with said first fastening means, whereby said lock package is releasably attachable to said cable package in said central cavity thereof.

8. Modular packaging according to claim 7 wherein one of said first and second fastening means is comprised of a pad bearing a multiplicity of minute hooks and the other of said first and second fastening means is comprised of a pad bearing a looped pile, whereby said hooks are releasably engageable in said looped pile.

9. Modular packaging according to claim 7 wherein said first fastening means is comprised of a plurality of coplanar slots defined in said interior bubble wall and said second fastening means is comprised of a plurality of laterally projecting tabs on said stiff backing, whereby said tabs are insertable into said slots to releasably hold said lock package in said cavity.

10. Modular packaging according to claim 9 wherein said interior wall defines projection means protruding laterally into said cavity and said slots are defined in said projection means.

11. Modular packaging according to claim 10 wherein said modular bubble package is further comprised of a cable backing means including a stiff support beneath said cable and beneath said cavity whereby said bubble and said stiff support encapsulate said cable.

12. Modular packaging according to claim 11 wherein said slots are defined in said projection means proximate to said stiff support.

13. Modular packaging according to claim 10 wherein said modular lock package includes a bubble top mounted atop said stiff backing and the edges of said bubble top and said stiff backing are coterminous and said bubble top and said stiff backing encapsulate a lock therebetween.

14. A modular packaging method for assembling sets of different types of bicycle locks with different types of bicycle cables in different combinations of a single lock with a single cable comprising:

packaging different types of bicycle cables in cable packages each including a bubble for receiving a coiled cable and an annular interior wall defining a cavity therewithin and defining a plurality of spaced, coplanar slots located in said interior wall, wherein all of said annular interior walls are of uniform geometric configuration and all of said slots are uniformly spaced and located in said walls, packaging different types of bicycle locks in lock packages each having a flat, stiff backing with tabs thereon arranged to extend into corresponding slots in each of said interior walls of said bubble packages, selecting bicycle cables and bicycle locks to be assembled into sets, and inserting said tabs of each of said selected lock packages into corresponding slots in a separate one of said selected cable packages, thereby seating each of said lock packages into the cavity of a separate one of said cable packages.

15. A method according to claim 14 further comprising removing at least some of said selected lock packages from at least some of said selected cable packages and recombining at least some of said selected lock packages with other cable packages.

* * * * *